United States Patent [19]

Wilner

[11] Patent Number: 4,660,655

[45] Date of Patent: Apr. 28, 1987

[54] PILE-DRIVING APPARATUS AND METHOD OF OPERATING SUCH APPARATUS

[76] Inventor: Pieter Wilner, 4 Emily Hobhouse St., Parow North, South Africa

[21] Appl. No.: 687,175

[22] Filed: Dec. 28, 1984

[30] Foreign Application Priority Data

Dec. 29, 1983 [ZA] South Africa ..... 83/9709

[51] Int. Cl.[4] ..... E21B 1/04

[52] U.S. Cl. ..... 173/82; 173/87; 200/61.47

[58] Field of Search ..... 173/1, 19, 20, 81, 82, 173/86–89; 405/232; 200/61.47

[56] References Cited

U.S. PATENT DOCUMENTS

| | | | |
|---|---|---|---|
| 2,214,197 | 9/1940 | Jackson | 200/152 |
| 3,938,595 | 2/1976 | Swenson | 173/87 X |
| 4,002,211 | 1/1977 | Holland | 173/87 |
| 4,099,040 | 7/1978 | Bitko | 200/61.47 X |
| 4,493,956 | 1/1985 | Yeoman | 200/61.47 |

FOREIGN PATENT DOCUMENTS

| | | |
|---|---|---|
| 2034382 | 10/1971 | Fed. Rep. of Germany . |
| 1100681 | 9/1955 | France . |
| 57765 | 8/1945 | Netherlands . |
| 983403 | 2/1965 | United Kingdom . |
| 1191942 | 5/1970 | United Kingdom . |
| 1234164 | 6/1971 | United Kingdom . |
| 1261220 | 1/1972 | United Kingdom . |
| 1294915 | 11/1972 | United Kingdom . |
| 1407076 | 9/1975 | United Kingdom . |
| 1452067 | 10/1976 | United Kingdom . |
| 1537793 | 1/1979 | United Kingdom . |
| 1572349 | 7/1980 | United Kingdom . |
| 1595416 | 8/1981 | United Kingdom . |
| 2093511 | 9/1982 | United Kingdom . |

*Primary Examiner*—James M. Meister
*Assistant Examiner*—John L. Knoble

[57] ABSTRACT

Pile-driving apparatus comprises a drop hammer for imparting blows; a winch for lifting the drop hammer between successive blows, the winch comprising a winch drive, a winch drum, a clutch for disengageably engaging the winch drive with the winch drum, and a rope or cable connecting the drop hammer to the winch drum; a sensor comprising a mercury containing container mounted on the driven object or the hammer and having electrical terminals, for sensing the delivery of a blow by the drop hammer; and a timer. Upon sensing of the delivery of a blow by the drop hammer, the sensor causes the clutch to engage and the timer to be triggered. Upon engagement of the clutch the winch lifts the drop hammer. At the end of a predetermined time interval, determined by the timer, the clutch disengages again, thereby allowing the drop hammer to fall. This process repeats itself automatically.

1 Claim, 4 Drawing Figures

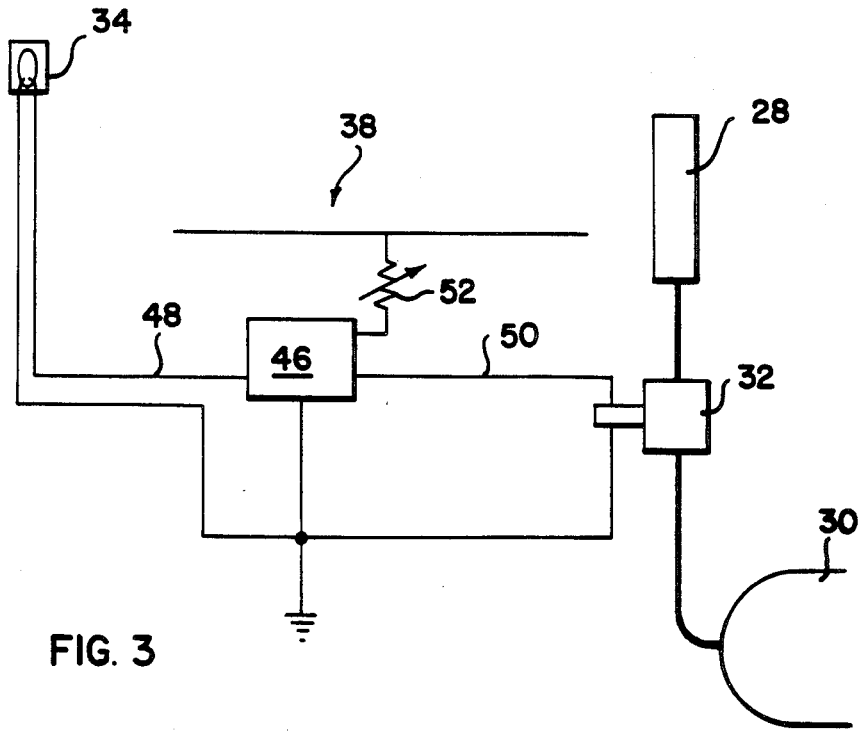
FIG. 3
FIG. 4
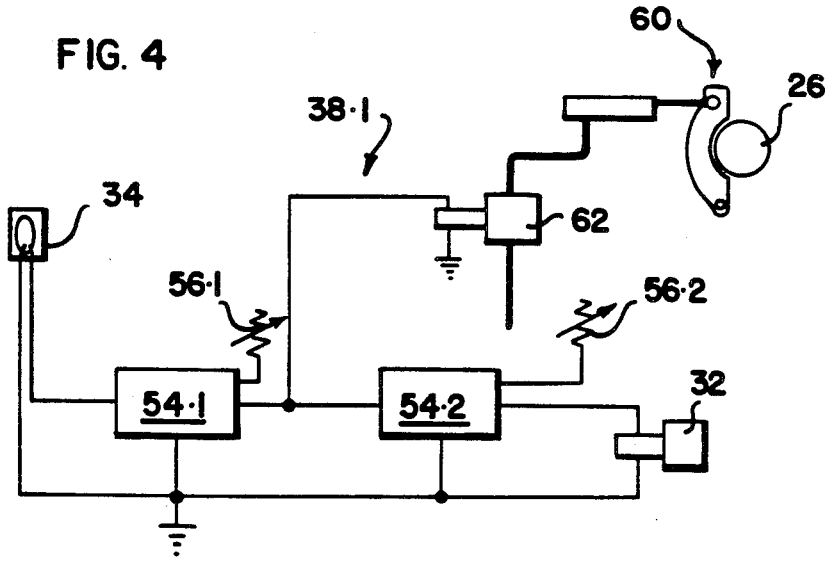

PILE-DRIVING APPARATUS AND METHOD OF OPERATING SUCH APPARATUS

FIELD OF THE INVENTION

This invention relates to pile-driving apparatus and to a method of operating such apparatus.

BACKGROUND TO THE INVENTION

In British patent specification No. 2 093 511 A there is disclosed pile-driving apparatus comprising a drop hammer for imparting blows to a pile, and a winch for lifting the drop hammer between successive blows. The winch comprises a winch drive, a winch drum, clutch means for disengageably engaging the winch drive with the winch drum, and a rope connecting the drop hammer to the winch drum, the rope passing over a sheeve. Sensing means is provided for sensing the load applied by the rope to the sheeve, and the output of the load sensitive means is fed to an analysis device. The analysis device is able to detect the moment of impact of the drop hammer on the pile, and provides an output causing the clutch to engage and the drop hammer therefore to be lifted. The winch drum is provided with marks, and fixed detectors are provided which are able to detect the direction of rotation and the angular position of the drum. The output of the detectors is fed to the analysis device which then provides a further signal to disengage the clutch when the drop hammer has reached a certain height. In this manner automatic operation of the pile driving apparatus is achieved.

The location of the load sensing means on what appears to be the mountings of the sheeve would require expensive modification of existing pile-driving apparatus. Furthermore, the location of the load sensing means at this critical point of the pile-driving apparatus can lead to long and costly breakdowns. Also, as will be apparent from the waveforms illustrated in FIGS. 2 and 3 of that specification, and by the fact that both the degree and direction of rotation displacement of the winch drum need to be detected, the analysis device will, of necessity, have to be of a complex nature, able to perform complex analyses, and, because of its complexity, be prone to malfunction.

It is an object of the present invention to provide pile-driving apparatus having control means for facilitating automatic operation of the apparatus, which control means is effective, simple in construction and operation, inexpensive, and can readily be incorporated in existing pile-driving apparatus of the manually operated kind.

SUMMARY OF THE INVENTION

According to the invention there is provided pile-driving apparatus comprising a drop hammer for imparting blows; hoisting means for lifting the hammer between successive blows, the hoisting means comprising a rope or cable connected to the drop hammer, take-up means for taking up the rope or cable, drive means, and disengageable drive engagement means for disengageably engaging the drive means with the take-up means; sensing means for sensing the delivery of a blow by the drop hammer, the drive engagement means being operative in response to the sensing means to engage the drive means with the take-up means in response to said sensing; and a timer operative in response to the sensing means to be triggered in response to said sensing, the drive engagement means being operative in response to the timer to disengage the drive means from the take-up means a predetermined time interval after the timer is triggered.

The timer may be adjustable, so as to permit adjustment of said predetermined time interval.

The sensing means may comprise a container containing an electrically conductive fluid such as, for example, mercury and having a pair of conductor terminals exposed to the fluid, the fluid being displaceable in the container to make or break electrical contact between the conductor terminals.

The sensing means may be mounted on a driven object to which said blows are imparted.

Said timer may be a first timer, there being provided a second timer for providing a predetermined time delay, less than said predetermined time interval, between the time of said sensing and engagement of the drive engagement means. Said second timer may be adjustable, so as to permit adjustment of said predetermined time delay.

The apparatus may further comprise brake means for braking the take-up means, the brake means being operative in response to the second timer to brake the take-up means for at least part of the duration of said predetermined time delay.

Further according to the invention there is provided a method of operating pile-driving apparatus comprising a drop hammer for imparting blows; hoisting means for lifting the hammer between successive blows, the hoisting means comprising a rope or cable connected to the drop hammer, take-up means for taking up the rope or cable, drive means, and disengageable drive engagement means for disengageably engaging the drive means with the take-up means; and sensing means for sensing the delivery of a blow by the drop hammer, the drive engagement means being operative in response to the sensing means to engage the drive means with the take-up means in response to said sensing, and causing the drive engagement means in response to the timer to disengage the drive means from the take-up means a predetermined time interval after the timer is triggered.

The timer may be a first timer, there being a second timer which is triggered in response to said sensing, the second timer delaying engagement of the drive engagement means for a predetermined time delay, less than said predetermined time interval, from the time of said sensing.

The take-up means may be braked for at least part of the duration of said time delay.

The invention will now be described in more detail, by way of example, with reference to the accompanying drawings.

BRIEF DESCRIPTION OF THE DRAWINGS

In the drawings:

FIG. 3 is an electrical/pneumatic circuit diagram of control means forming part of the apparatus; and FIG. 4 is an electrical/pneumatic circuit diagram of control means in accordance with another embodiment of the invention.

DETAILED DESCRIPTION OF PREFERRED EMBODIMENTS

Figure 1:
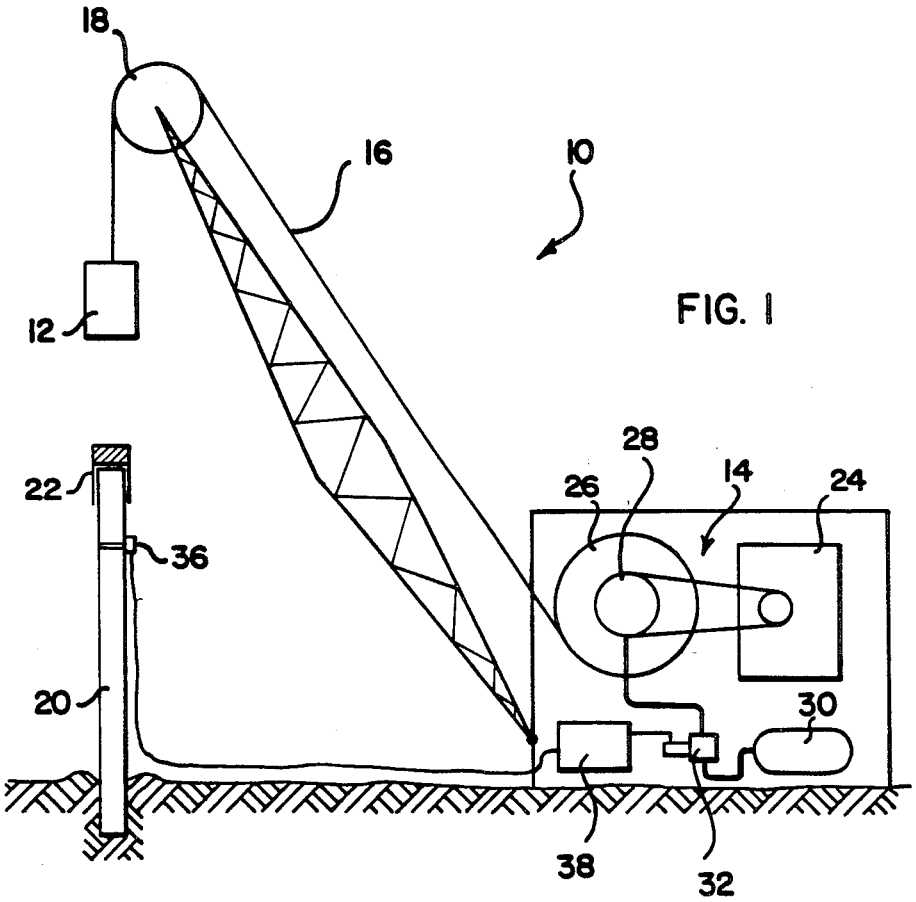
FIG. 1 is a diagrammatic representation of pile-driving apparatus in accordance with the invention.

Referring first to FIG. 1, reference numeral 10 generally indicates pile-driving apparatus comprising a drop hammer 12 and hoisting means in the form of a winch 14 for lifting the drop hammer. The drop hammer is connected to the winch by means of a wire rope 16 which passes over a sheave 18 forming part of the apparatus.

Reference numeral 20 indicates a pile which is being driven into the ground by the apparatus 10. A protective helmet 22 fits over the upper end of the pile.

The winch 14 comprises a winch drive 24, a winch drum 26, and a pneumatically operated clutch 28 for disengageably engaging the winch drive with the winch drum. There is an air receiver 30 for compressed air, this being connected to the clutch 28 via a solenoid-operated valve 32.

The apparatus 10 further comprises sensing means in the form of an impact sensitive sensor 34 (FIG. 2) located in a steel casing 36, the steel casing being detachably secured, e.g. by means of a strap, to the pile 20. It could, alternatively, be secured permanently to the helmet 22, such as by welding. The sensor 34 is connected to a control device 38, the control device having an electrical output which is connected to the solenoid-operated valve 32.

Figure 2:
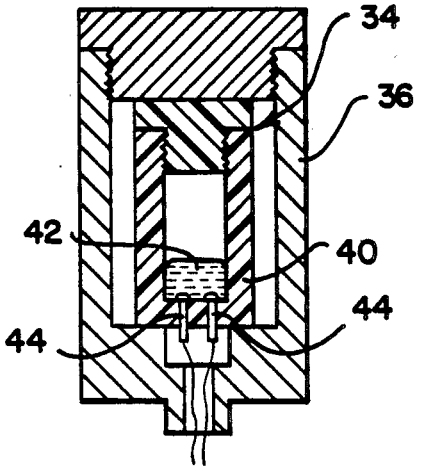
FIG. 2 is a vertical section of a sensor and its casing, forming part of the apparatus.

Referring now to FIG. 2, the impact sensitive sensor 34 comprises a container 40 of an electrically insulating material such as Nylon, the container containing a quantity of mercury 42 and having a pair of conductor terminals 44 exposed to the mercury. The sensor 34 will normally be in the condition illustrated in FIG. 2, i.e. with the mercury 42 bridging the terminals 44. Upon receiving an impact, however, the mercury 42 will temporarily be displaced away from the terminals 44, causing a temporary open circuit.

Referring now to FIG. 3, the control device 38 comprises an electrical timer 46 having the sensor 34 connected to its trigger 48. The timer is designed to produce an output voltage on its output terminal 50 for a predetermined time interval after being triggered, the time interval being adjustable by means of a variable resistor 52. The design of such a timer will be well within the capabilities of a skilled artisan and will therefore not be described in detail. It could, for example, include an integrated circuit known as a 555 timer conducted in a monostable or "one-shot" configuration.

Operation of the apparatus 10 is as follows. Normally, the solenoid operated valve 32 is closed and the clutch 28 thus disengaged. To start the apparatus, the valve 32 is opened manually, admitting compressed air to the clutch 28 and thus causing the clutch to engage. This results in drive being transmitted from the winch drive 24 to the winch drum 26, causing the drop hammer 12 to be lifted. When the drop hammer has been lifted to the desired height, the valve 32 is released, causing the clutch 28 to disengage. The drop hammer 12 now falls freely, unwinding the drum 26. The impact resulting from the drop hammer hitting the helmet 22 is sensed by the sensor 34, triggering the timer 46. This results in the solenoid operated valve 32 opening for a predetermined time interval, the time interval being adjustable by means of the variable resistor 52. Thus, for the predetermined time interval, the clutch 28 will be engaged, causing the drop hammer 12 again to be lifted. The distance for which the drop hammer is lifted will depend on the time setting of the timer 46 and the speed of the winch drive 24. At the end of the time interval the clutch 28 will again disengage and the process as described above will automatically repeat itself.

In order to stop the apparatus, the solenoid operated valve 32 is switched over to manual operation.

There is normally a certain amount of time lag between opening of the solenoid-operated valve 32 and engagement of the clutch 28. To reduce this time lag, the clutch may be such that it is spring biased towards the engaged condition, the admission of compressed air being effective to disengage the clutch. Operation of the timer 46 and the solenoid-operated valve 32 will then be such that, upon triggering of the timer, the valve is closed and compressed air exhausted from the clutch operating mechanism. In this manner the response of the clutch can be speeded up as compressed air can normally be exhausted from the clutch operating mechanism much faster than it is possible to admit compressed air to the mechanism.

To prevent overshooting of the drop hammer 12, the control device 38 may, for example, comprise an audible alarm which is activated should the terminals of the sensor 34, due to malfunction, not be bridged again within a predetermined time interval after opening.

It will be understood that, with a very short time setting of the timer 46, the apparatus can be used to impart a vibratory force to a pile such as during extraction of a pile casing or for consolidating a concrete filling in such a casing. It will furthermore be appreciated that the apparatus could be used to compact soil, in which event the drop hammer 12 will be arranged to impart blows directly to the soil, the sensor 34 being mounted on the drop hammer.

Referring now to FIG. 4, there is shown part of a control device 38.1 according to another embodiment of the invention. That part not shown in FIG. 4 is identical to the device shown in FIG. 3. In this embodiment the timer 46 of FIG. 3 is replaced by two timers 54.1 and 54.2, each being individually adjustable by variable resistors 56.1 and 56.2 respectively. The timers 54.1 and 54.2 are connected in series such that the first timer 54.1 is triggered in response to the sensor 34, to provide a time delay, the second timer 54.2 being triggered when the first timer has reached the end of the time delay. In this embodiment therefore, there will be an adjustable time delay between the sensor 34 sensing the delivery of a blow, and the clutch 28 engaging.

As an optional feature, a pneumatically operated brake 60 may be provided for the winch drum 26. The brake 60 is connected to the air receiver 30 via a solenoid operated valve 62, the valve 62 being operated by the output of the first timer 54.1. When this feature is included, the drum 26 will be braked for the duration of the time delay provided by the first timer 54.1, thus preventing undue shock loads in the rope 16 resulting from the winch drum continuing to unwind subsequent to the point of impact and the slack in the rope being taken up again when the clutch engages.

I claim:

1. Pile-driving apparatus comprising a drop hammer for imparting blows; hoisting means for lifting the hammer between successive blows, the hoisting means comprising a rope or cable connected to the drop hammer, take-up means for taking up the rope or cable, drive means, and disengageable drive engagement means for disengageably engaging the drive means with the take-up means; impact-sensitive means for sensing the delivery of a blow by the drop hammer, the drive engagemet means being operative in response to the sensing means to engage the drive means with the take-up means in response to said sensing; a first timer operative in response to the sensing means to be triggered in response to said sensing, the drive engagement means being operative in response to the timer to disengage the drive means from the take-up means a predetermined time interval after the timer is triggered, a second timer for providing a predetermined time delay, less than said predetermined time interval, between the time of said sensing and engagement of the drive engagement means, said second timer being adjustable, so as to permit adjustment of said predetermined time delay.

* * * * *